US010695634B2

(12) United States Patent
Cuenin et al.

(10) Patent No.: US 10,695,634 B2
(45) Date of Patent: Jun. 30, 2020

(54) METHOD AND SYSTEM FOR TIMING A BASKETBALL MATCH

(71) Applicant: Swiss Timing Ltd, Corgemont (CH)

(72) Inventors: Thierry Cuenin, Villers-le-Lac (FR); Fabien Masse, Lausanne (CH)

(73) Assignee: Swiss Timing Ltd, Corgemont (CH)

( * ) Notice: Subject to any disclaimer, the term of this patent is extended or adjusted under 35 U.S.C. 154(b) by 93 days.

(21) Appl. No.: 16/053,929

(22) Filed: Aug. 3, 2018

(65) Prior Publication Data

US 2019/0076713 A1 Mar. 14, 2019

(30) Foreign Application Priority Data

Sep. 12, 2017 (EP) ..... 17190608

(51) Int. Cl.
*A63B 69/00* (2006.01)
*A63B 63/08* (2006.01)
(Continued)

(52) U.S. Cl.
CPC ..... *A63B 63/083* (2013.01); *A63B 24/0021* (2013.01); *A63B 69/0071* (2013.01); *A63B 71/0686* (2013.01); *G07C 1/22* (2013.01); *G07C 1/28* (2013.01); *A63B 2024/0028* (2013.01); *A63B 2024/0037* (2013.01); *A63B 2220/62* (2013.01); *A63B 2220/805* (2013.01); *A63B 2220/806* (2013.01); *A63B 2220/833* (2013.01)

(58) Field of Classification Search
CPC ..... A63B 63/083; A63B 24/0021; A63B 69/0071; A63B 71/0686; A63B 2024/0028; A63B 2024/0037; A63B 2220/62; A63B 2220/805; A63B 2220/806; A63B 2220/833; G07C 1/22; G07C 1/28
USPC ..... 473/422, 432, 433, 447, 449, 477–489
See application file for complete search history.

(56) References Cited

U.S. PATENT DOCUMENTS 4,045,788 A * 8/1977 Castelli ..... A63B 71/06 340/323 R
4,637,732 A * 1/1987 Jones ..... G04C 10/04 340/309.16

(Continued)

FOREIGN PATENT DOCUMENTS

FR 2 643 824 A1 9/1990
WO WO 2010/146586 A2 12/2010
WO WO 2015/143314 A1 9/2015

*Primary Examiner* — Mitra Aryanpour
(74) *Attorney, Agent, or Firm* — Oblon, McClelland, Maier & Neustadt, L.L.P.

(57) ABSTRACT

A system for timing a basketball match includes a timing device linked to an optical ball detector and/or linked to at least one visual ball detector for detecting a ball in a basketball hoop. The optical ball detector includes an optical sensor positioned near or on the basketball hoop, and the visual detector includes at least one kinetic camera for detecting the motion of the ball in the basketball hoop with processing of the signal. A method for timing the basketball match, using the system, includes starting to count game time by activating the timing device, capturing, using the optical sensor and/or the kinetic camera, the passage of the basketball ball into a rim of the basketball hoop, and transmitting at least one signal detecting the passage of the ball into the basketball hoop to the timing device in order to stop game time.

16 Claims, 3 Drawing Sheets

(51) Int. Cl.

| | |
|---|---|
| ***G07C 1/28*** | (2006.01) |
| ***A63B 71/06*** | (2006.01) |
| ***G07C 1/22*** | (2006.01) |
| ***A63B 24/00*** | (2006.01) |

(56) References Cited

U.S. PATENT DOCUMENTS

| | | | | |
|---|---|---|---|---|
| 5,039,977 | A | 8/1991 | Mele et al. | |
| 5,214,954 | A * | 6/1993 | Abbott | A63B 63/083 73/12.01 |
| 5,341,121 | A * | 8/1994 | Rada | A63B 71/06 235/1 B |
| 6,389,368 | B1 * | 5/2002 | Hampton | A63B 24/0084 702/179 |
| 6,980,113 | B1 * | 12/2005 | Uehran | A63B 71/06 340/12.54 |
| 7,570,153 | B2 * | 8/2009 | Gorman | G04F 1/005 340/323 R |
| 7,632,198 | B2 * | 12/2009 | Lee | G04F 10/00 340/309.16 |
| 2002/0049102 | A1 * | 4/2002 | Taylor | A63B 24/0021 473/447 |
| 2008/0254866 | A1 * | 10/2008 | Young | A63B 24/0021 463/25 |
| 2010/0085167 | A1 | 4/2010 | Costabile | |
| 2011/0306444 | A1 * | 12/2011 | McKay | A63B 63/083 473/415 |
| 2012/0099405 | A1 | 4/2012 | Lidor et al. | |
| 2012/0230154 | A1 * | 9/2012 | Woycechowsky | G07C 1/28 368/10 |
| 2012/0322587 | A1 * | 12/2012 | Duke | A63B 69/0071 473/450 |
| 2015/0265897 | A1 | 9/2015 | Gordon et al. | |
| 2017/0098125 | A1 | 4/2017 | Marty et al. | |
| 2019/0076713 | A1 * | 3/2019 | Cuenin | A63B 63/083 473/433 |
| 2019/0076714 | A1 * | 3/2019 | Dougherty | A63B 63/083 340/815.45 |

* cited by examiner

METHOD AND SYSTEM FOR TIMING A BASKETBALL MATCH

This application claims priority from European patent application No. 17190608.4 filed on Sep. 12, 2017, the entire disclosure of which is hereby incorporated herein by reference.

FIELD OF THE INVENTION

The invention relates to a method for timing a basketball match.

The invention also relates to a system for timing a basketball match for implementing the method.

BACKGROUND OF THE INVENTION

In a sporting competition, such as a basketball match, it is known to use electronic devices in particular to detect a ball entering into the basketball hoop. These devices comprise sensor elements for detecting any passage of a ball into the hoop, for example from above.

In this respect, reference may be made to patent application WO 2016/057535 A1, which accordingly describes a basketball hoop with means for detecting any ball passing through said hoop from above. For this detection, the net of the hoop comprises a conductive element able to extend with the net when the ball enters into the hoop. The electrical property of this conductive element may change, in particular by way of an increase in its resistivity. This conductive element is linked to a detection circuit. It is possible to determine an electrical variation profile of the element when the ball passes into the net. This conductive element may be a conductive elastomer material. A communication unit is also provided for transmitting a detection signal from the detection circuit to a processing station. However, there is no provision for the detection assembly to stop a timer when the ball passes into the hoop, this constituting a drawback.

U.S. Pat. No. 5,418,517 describes an apparatus for establishing the score in a basketball match. A paddle is provided underneath the rim of the basketball hoop for detecting the entry of the ball. The bending of the paddle commands a switch so as primarily to establish the score in an electronic housing for displaying the score. There is provision to determine the various shots that are scored during the match, and there is also determination of the time left on a shot clock and the shooting percentage. However, there is no provision for the apparatus to stop a timer when the ball passes into the hoop, this constituting a drawback.

Patent FR 2 643 824 B1 describes a device for detecting and signaling successful shots in a basketball match. At least one signal emitter is positioned on the entry rim of the basketball hoop and at least one signal receiver is also positioned facing the corresponding emitter on the rim. When there is no ball entering into the hoop, the receiver receives the signal from the emitter. However, when a ball enters the hoop, the entry of the ball is able to be detected by an interruption in reception of the signal by the receiver. The interruption of the captured signal therefore makes it possible to activate visual or acoustic information. However, there is no provision for the detection device to stop a timer when the ball passes into the hoop, this constituting a drawback.

Patent U.S. Pat. No. 6,389,368 B1 describes an apparatus for detecting basketball shots in order to establish a score and shot statistics. The apparatus comprises a visual detection device positioned on the backboard of the hoop, linked to an information-processing device. This visual detection device is a sensor with a plurality of pixels for capturing the position of the ball at the start of the shot and the moment when it passes into the basketball hoop and for transmitting signals relating to a difference in luminous intensities to the processing device in order to determine the position of the ball and its passage into the net of the hoop. A vibration sensor is also installed on the backboard of the basketball hoop in order to supply information regarding the contact of the ball inside the rim of the basketball hoop. However, there is no provision for the detection device to stop a timer when the ball passes into the hoop, this constituting a drawback.

During the timing of a basketball match, and in the time interval primarily in the last two minutes of play, a player from a team scores, that is to say shoots a basket. The top of the ball passes through the rim of the basketball hoop, and the game thus stops. The match officials are responsible for making the decision as to when to stop the game, and not the referee. As a result, even the referee's whistle may not be taken into account for stopping game time. During a match, there may also be provision for the lead referee to ask the timekeeper to add time to the game clock. Under these conditions, the rhythm of the game is slowed down at a critical point of the match. It is therefore necessary to find a solution that guarantees accurate stoppage of play at the instant when the ball passes through the rim of the basketball hoop, this being an objective of the invention.

SUMMARY OF THE INVENTION

The aim of the invention is therefore to mitigate the drawbacks of the abovementioned prior art by proposing a method for timing a basketball match. To this end, at least one optical sensor is positioned near or on the basketball hoop in order to detect a ball entering into the hoop during the match in order to stop the game time.

To this end, the invention relates to a method for timing a basketball match using a timing system comprising a timing device linked to at least one optical ball detector and/or linked to at least one visual ball detector for detecting a ball in a basketball hoop, the optical ball detector comprising at least one optical sensor, which is positioned near or on the basketball hoop, and the visual ball detector comprising one or more kinetic cameras for detecting the motion and the depth of the ball in the basketball hoop, the method comprising the steps of:

- starting to count game time by activating the timing device,
- capturing, using the optical sensor, the passage of the basketball into a rim of the basketball hoop from above the hoop, and/or visually detecting, by way of at least one kinetic camera, the motion of the basketball passing into the rim of the basketball hoop through information processing, and
- transmitting at least one signal detecting the passage of the ball into the basketball hoop from the optical ball detector and/or from the visual detector to the timing device in order to stop game time.

One advantage of the timing method lies in the fact that optical detection by an optical ball detector in the hoop and/or visual detection by information processing is provided in such a way as to detect the passage of the ball into the rim of the basketball hoop so as to supply a detection signal to a timing device in order to stop the game time. The optical ball detector is at least one optical sensor, positioned on the basketball hoop or on a fitting for connecting the hoop to a basketball backboard or even on said basketball backboard, for detecting the passage of the ball into the rim of the hoop. The visual detection consists of one or more kinetic cameras (Kinect®) with motion and depth recognition, and of an integrated infrared system.

Advantageously, in a simple design of the timing system, the optical ball detector comprises at least one optical light sensor and a light source facing the sensor, these being able to be positioned on a surface of the rim of the basketball hoop or integrated into the rim of the basketball hoop. The light source positioned facing and diametrically opposite the optical sensor supplies, during the game, a ray of light that is captured by the optical sensor. The passage of the ball into the rim of the basketball hoop temporarily interrupts the reception of light by the optical sensor. This makes it possible to supply a detection signal, following the reception or absence of reception of the ray of light, to the timing device in order to stop the game time.

Advantageously, in order to accurately detect the passage of the ball into the hoop, the optical sensor of the optical ball detector may be associated with a kinetic camera of the visual detector with motion and depth information processing or with a colour camera, an infrared camera or a LIDAR device. The LIDAR device is also capable of determining the distance from the sensor to the ball in a two-dimensional or three-dimensional space. Under these conditions, it is not necessary to use an additional light source situated on the rim of the basketball hoop.

Accurate timing of a basketball match is one of the foundations of modern basketball. The timing system that is presented connects at least one optical sensor with optical detection and/or visual motion and depth detection with the timing device and assists in improving the quality of the game by removing potential human errors.

Advantageously, the ball detector is easy to install and calibrate in the hoop in a manner linked to the timing device. This makes it possible to quickly and accurately provide interruptions in play.

To this end, the invention also relates to a timing system for implementing the method for timing a basketball match according to one of the preceding claims, wherein the timing system comprises a timing device linked to at least one optical ball detector and/or linked to at least one visual ball detector for detecting a ball in a basketball hoop, the optical ball detector comprising at least one optical sensor, which is positioned near or on the basketball hoop, and the visual ball detector comprising one or more kinetic cameras for detecting the motion and the depth of the ball in the basketball hoop, and in that the optical ball detector and/or the visual ball detector are intended to transmit at least one signal detecting the passage of the ball into the basketball hoop to the timing device so as to stop game time.

BRIEF DESCRIPTION OF THE DRAWINGS

The aims, advantages and features of the method and of the system for timing a basketball match according to the invention will become more apparent from the following description of at least one nonlimiting embodiment illustrated by the drawings, in which.

DETAILED DESCRIPTION OF THE INVENTION

In the following description, all of the elements of a system for timing a basketball match that are well known to those skilled in the art in this technical field will be referred to only in a simplified manner.

Figure 1:
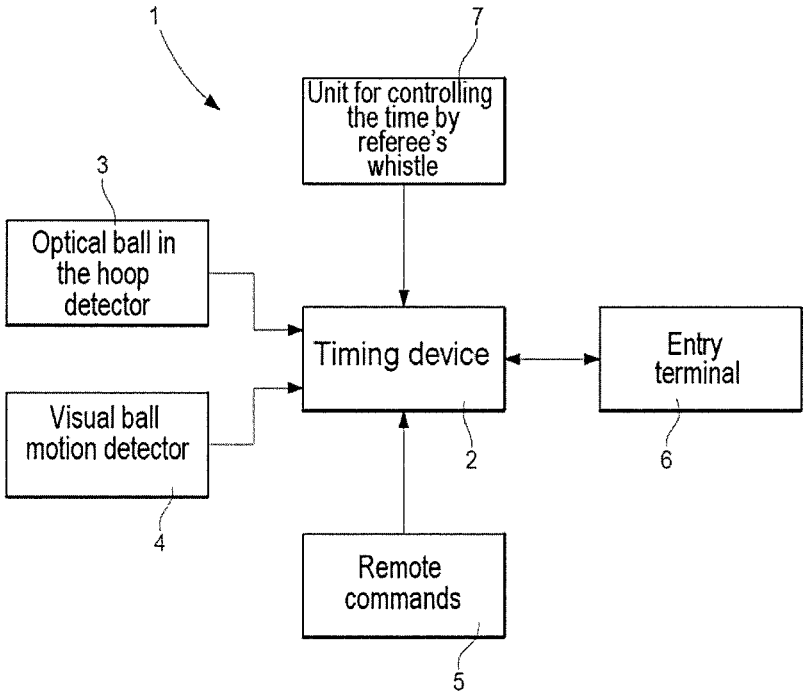
FIG. 1 shows a block diagram of the components of a system for timing a basketball match according to the invention, FIG. 2 schematically shows a three-dimensional view of a basketball hoop with various electronic components for detecting a ball in the hoop according to the invention, FIG. 3 schematically shows a side view of a basketball hoop attached to a backboard installed on a support pole with an optical ball detector linked to the timing device of the timing system according to the invention, and FIG. 4 schematically shows a view of the position of the kinetic cameras of the visual detector for motion and depth detection according to the invention.

FIG. 1 shows the various elements of a timing system 1 for timing a basketball match. The timing system essentially comprises a timing device 2 and a ball detector 3, 4. The ball detector may comprise an optical ball detector 3 for detecting a ball entering into a basketball hoop during the match and/or a visual ball motion and depth detector 4. At the start of a basketball match, the timing device 2 is initiated and a time is counted in the timing device 2, which comprises a processing or calculating unit having timing software with an oscillator defining a time base. The optical ball detector 3, which is preferably situated near or on a surface of the rim of the basketball hoop, may be activated at the start of the match by the timing device 2 or may be initiated, independently of the timing device 2, by a manual command or a remote command. The visual ball motion and depth detector 4 may also be activated at the start of the match. As soon as, during the game, a ball is detected entering into the basketball hoop, the ball detector 3, 4 transmits a data or detection signal to the timing device 2 in order to stop the game time.

Figure 4:
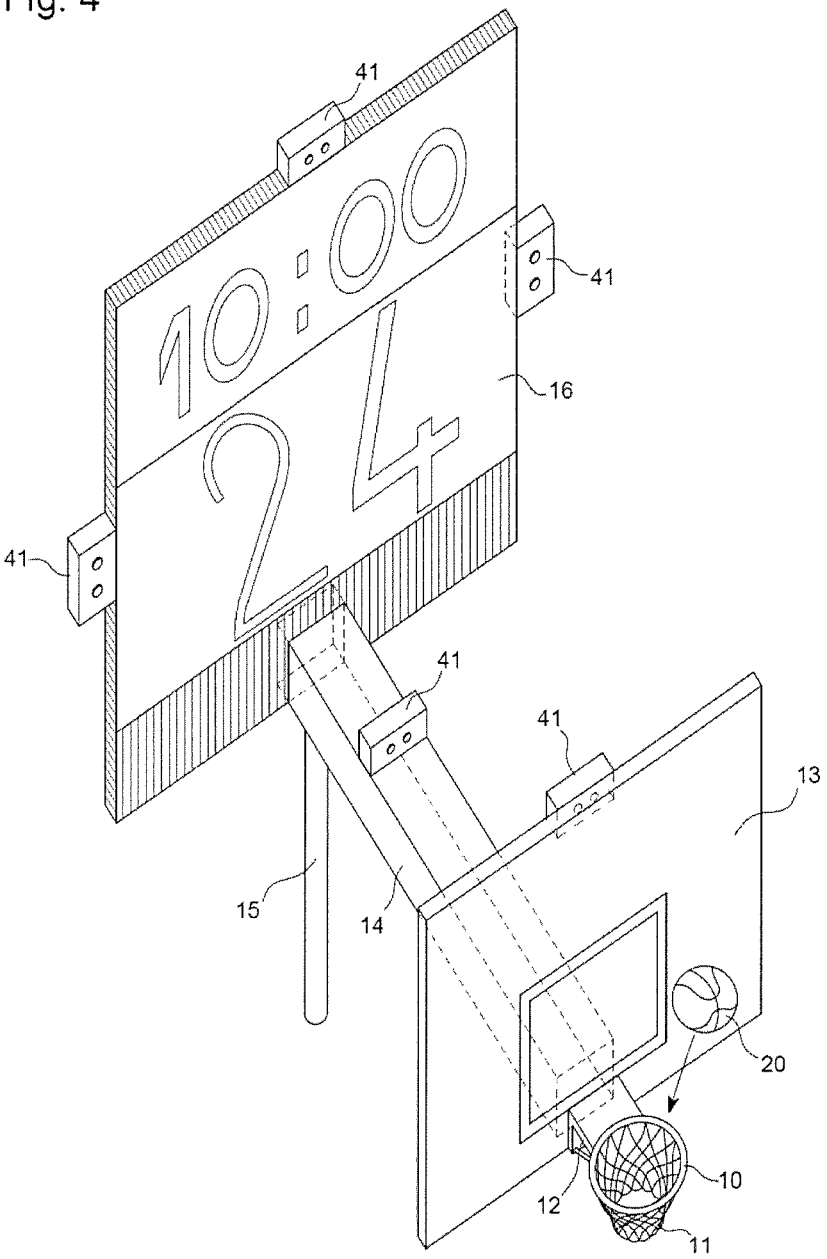

As shown schematically in FIG. 4, it is possible to equip the timing system 1 with the visual ball detector 4, which comprises one or more kinetic cameras 41 (Kinect®) positioned at various locations in order to detect and recognize movements of the ball 20 through the net 11 of the basketball hoop 10. This visual detection is associated with digital processing, which confirms the passage of the ball 20 into the hoop 10.

The timing system 1 may also comprise an entry terminal 6, which is put into operation in order in particular for the officials to control the game time. The timing device is therefore linked to the entry terminal in order to control the game time. However, it may also be contemplated for the timing device 2 to be integrated into the entry terminal 6, which may be positioned on a game table next to the court. The timing system 1 may also comprise one or more remote control devices 5 in order for a match official to wirelessly control the timing device by way of a portable object, and a unit for controlling the time 7 by way of a referee's whistle, which unit is linked to the timing device. Of course, this unit for controlling the time may consist of an electronic referee's whistle capable of transmitting a radiofrequency signal to the timing device signaling stoppages in play.

The optical ball detector in the hoop 3 may be linked by an electrical wire or cable or by way of wireless communication to the timing device 2. The optical ball detector 3 essentially comprises at least one optical sensor positioned near or on the basketball hoop. This optical sensor may be a light sensor, which is formed of at least one photoreceptive diode or one pixel, or of an array of photoreceptive diodes or pixels. With a visual ball detector 4, the optical sensor may be a kinetic camera with ball motion and depth information processing.

The optical sensor of the optical ball detector 3 may also be a colour camera, an infrared camera or a LIDAR device, so as to take various images of the ball at the moment when it passes into the basketball hoop and be able to transmit the data signal relating to the images to the timing device 2. This LIDAR device makes it possible to capture light and the intensity thereof in order to determine the distance from the sensor to the ball in a two-dimensional or three-dimensional space. The optical ball detector in the hoop 3 may also comprise a light source facing a simple optical light sensor, as explained hereinafter with reference to FIGS. 2 and 3. The detection signal of the optical ball detector 3 and/or of the visual ball detector 4 is decisive in stopping the game time when the ball enters into the hoop with respect to the signaling of a stoppage by a referee's whistle or by a match official.

Figure 2:
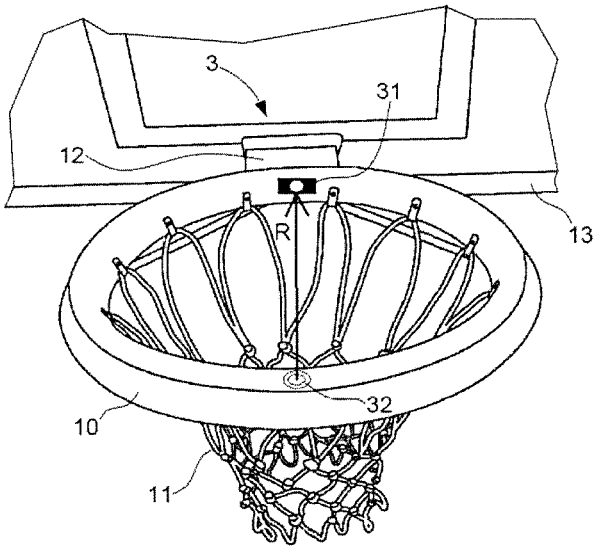
Figure 3:
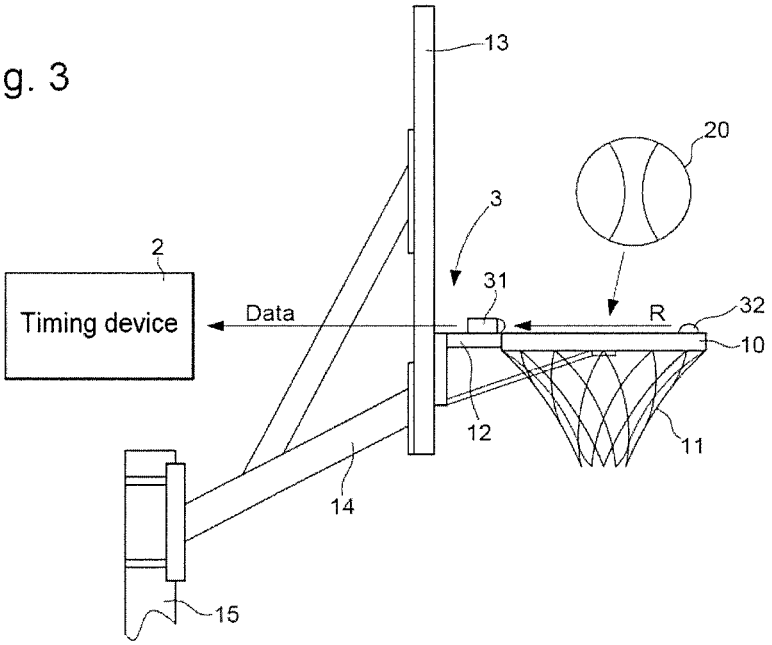

FIGS. 2 and 3 show a simplified embodiment, in a three-dimensional view, of a basketball hoop with the optical ball detector 3 and a side view of a basketball hoop attached to a backboard installed on a support pole with the optical ball detector 3 and/or a visual ball detector 4 shown in FIG. 4.

FIG. 4 shows a simplified embodiment, in a three-dimensional view, of an assembly of a basketball hoop attached to a backboard 13, which may be partly transparent. The basketball backboard 13 is also linked, by at least one bar 14, to a support pole 15, which is generally installed vertically at the edge of the basketball court. A score display panel 16 with a visual ball detector 4, which is formed of one or more kinetic cameras 41, may be installed on the pole 15. The bar(s) 14 and the pole 15 are generally made of metal. The cameras 41 may also be positioned on the bar 14 and/or on the backboard 13. In order for the kinetic cameras to operate correctly, they preferably have to be positioned at a distance of less than 3 m from the basketball hoop and positioned so as to see in the direction of the basketball hoop.

It may be defined that the basketball hoop may form part of the timing system. The optical ball detector 3 and/or the visual ball detector 4 are linked to the timing device 2 of the timing system. The dimensions and the position of the components shown in FIGS. 2, 3 and 4 are not complied with accurately, and they may of course be positioned at other locations according to the invention.

The basketball hoop comprises a rim 10 through which the ball 20 has to pass from above in order to score a basket, and a net 11 attached at the inner or outer periphery of the rim 10 in order to receive the ball coming through the rim. The ball 20 passes completely through the net 11, which is open at the bottom. The rim 10 is linked to a basketball backboard 13 by a connection fitting 12. The rim 10, the connection fitting 12 and the backboard 13 are made of solid impact-resistant material. The basketball backboard 13 is also linked, by bars 14, to a support pole 15, which is generally installed vertically at the edge of the basketball court. The bars 14 and the pole 15 are generally made of metal. Of course, two basketball hoop assemblies are situated at each side of the basketball court for a basketball match.

The optical ball detector 3 comprises in particular at least one optical sensor 31 positioned on a surface of the rim or partly integrated into the rim, with a visible light reception portion on or in the rim 10 of the basketball hoop. This optical sensor 31 may be situated at a first position on a surface of the rim or in the rim 10 on the perimeter of the rim from the attachment of the rim 10 to the connection fitting 12. Of course, it may also be contemplated to situate the optical sensor 31 directly on the connection fitting 12 or also in contact with the basketball backboard 13. In this scenario, this may involve an optical sensor in the form of a camera, as indicated above.

In FIGS. 2, 3 and 4, the optical sensor 31 of simple design is shown to be attached close to the connection fitting 12 with its light reception surface preferably directed towards the centre of the rim 10 of the hoop. At least one kinetic camera of the visual detector 4, not shown, may also be situated on the hoop or the backboard holding it.

The optical ball detector 3 may also comprise at least one light source 32 positioned on a surface of the rim 10 or partly integrated into the rim. The light source 32 may be situated at a second position on or in the rim 10 on the perimeter of the rim from the attachment of the rim 10 to the connection fitting 12. Preferably, the light source 32 is positioned in a position diametrically opposite the optical sensor 31 on one and the same surface of the rim and facing said optical sensor 31.

The light source 32 is mandatorily dependent on the technology used in the optical sensor 31. This light source 32 may be a light-emitting diode for emitting a ray R with a defined colour, such as in infrared, in the direction of the optical sensor 31 or an emission source of a laser beam. The optical sensor 31 is thus capable of capturing the light emission generated by the light source if no ball passes through the rim 10 of the basketball hoop.

The visual motion and depth detector 4 may, compulsorily or not, be associated with the optical ball detector 3. The visual detection and the information processing that it involves may independently confirm the passage of the ball into the hoop using the associated kinetic (Kinect®) technology.

The optical ball detector 3 comprises an acquisition unit, which is not shown but may be integrated into the structure of the optical sensor 31, for receiving a light detection signal from the optical sensor. A detection signal processing unit may also be provided in the optical ball detector 3 and/or in a visual ball detector 4 or in the timing device 2, or directly form part of the acquisition unit. The processing unit executes algorithms that detect a ball passing through the rim 10 of the hoop. A data communication Data may be performed from the optical ball detector 3, in particular from the optical sensor 31, to the timing device 2. The data communication Data may relate to the detection of a ball, which passes through the rim 10 of the basketball hoop during the game, in order to stop the game time in the timing device 2. The optical ball detector 3 may therefore be linked to the timing device 2 by an electrical wire or cable passing through the backboard 13, the bars 14 and the pole 15, or by way of wireless communication via radiofrequency signals.

The processing unit may also be situated close to the optical sensor 31, in particular on the connection fitting 12 of the basketball hoop. This processing unit may also be positioned directly in the timing device 2, as part of the timing software.

The aim of the optical ball detector 3 and/or the visual detector 4 for visual recognition using one or more kinetic cameras is to detect the moment when the ball 20 enters into the rim 10 and the moment when the upper part of the ball is level with or below the rim and already partly in the net 11. The optical sensor 31 detects the light from the light source 32 as long as there is no object positioned between the optical sensor 31 and the light source 32. By contrast, as soon as the bottom part of the ball 20 enters the rim 10 of the hoop from above, the optical sensor 31 no longer detects the light coming from the light source 32 and informs the processing unit or the timing device of this.

Thereafter, in order to be able to stop the game time in the timing device 2, the optical sensor 31 has to detect the ray R of light coming from the light source 32 again. It detects the ray R of light again once the top part of the ball 20 is level with or below the rim 10 of the hoop, where the optical sensor 31 and the light source 32 are located. A detection signal is supplied to the timing device 2, which takes into account the new light detection of the optical sensor after the start of the absence of reception of light in order to stop the game time. The timing device 2 comprises timing software, which is able to detect the instant of the absence of reception of the ray R of light by the optical sensor and then the renewed reception of the ray R of light in order to stop the game time. This means that the ball 20 has entered the rim 10 of the hoop, and a score is also recorded.

The acquisition unit of the optical ball detector 3 linked to the optical sensor 31 may also measure a difference in luminous intensities in order to be able to detect the reception or the absence of reception of the ray R of light from the light source 32 so as to overcome ambient light. For greater measurement accuracy, there may also be provision to situate a plurality of optical sensors 31 and a plurality of light sources 32 of different colours at various positions on a surface of the rim 10. Each optical sensor faces and is diametrically opposite a respective light source. A data communication with the timing device 2 is performed from the optical ball detector 3 in relation to the detection of each optical sensor 31.

There may be provision for the timing system 1 to associate, or not to associate, visual detection by kinetic cameras (Kinect®) by motion and depth detection in order to detect the passage of the ball into the rim of the hoop.

It should also be noted that, in the case of wireless communication of data or commands with the timing device 2, the optical ball detector 3 and/or the visual ball detector 4 may be activated by the timing device 2 at any moment before or during the game time.

It should also be noted that there may be provision for a step of calibrating the optical ball detector 3 and/or the visual ball detector 4 after the timing system is installed and before the timing device 2 starts to count game time. Calibration is necessary if just one optical sensor is used, such as a camera or a LIDAR device or a visual detection system using at least one kinetic camera (Kinect®). The calibration steps are firstly the detection of the edge of the rim by shape matching and secondly the detection of the volume on the basis of the detected shape. With regard to the operating time, there is detection of an object, such as the ball, with presence in the detected volume, and shape recognition in order to ensure the accuracy of the detected object that passes through the rim of the hoop. As indicated above, the information from a plurality of optical sensors combining varied technologies may be used to improve measurement accuracy, as well as one or more kinetic cameras (Kinect®) for visual detection.

From the description that has just been given, numerous variants of the method and of the system for timing a basketball match may be conceived by those skilled in the art, without departing from the scope of the invention defined by the claims. The optical light sensor may comprise two light reception surfaces positioned vertically on top of one another so as to make it possible to discern the direction in which a ball passes into the basketball hoop during the match. If an optical sensor and a light source are used, said light source may emit a ray of light intermittently or in a flash. A plurality of optical sensors and a plurality of light sources may be situated on an upper and/or lower surface of the rim of the basketball hoop so as also to make it possible to determine the direction in which the ball passes into the basketball hoop. The visual motion detection may be associated with or be used independently of the optical detection for detecting the passage of the ball into the hoop.

What is claimed is:

1. A method for timing a basketball match using a timing system comprising a timing device linked to at least one optical ball detector and/or linked to at least one visual ball detector for detecting a ball passing through a basketball hoop, the basketball hoop including a rim and a net, the at least one optical ball detector comprising at least one optical sensor, which is positioned near or on the basketball hoop, and the at least one visual ball detector comprising one or more kinetic cameras for detecting the motion and the position of the ball with respect to the basketball hoop, the method comprising:

starting to count game time by activating the timing device, capturing, using the at least one optical sensor, the passage of the basketball ball into the rim of the basketball hoop from above the hoop, and/or visually detecting, by way of the one or more kinetic cameras, the motion of the basketball ball passing into the rim of the basketball hoop through information processing, and transmitting at least one signal detecting the passage of the ball into the basketball hoop from the at least one optical ball detector and/or from the at least one visual detector to the timing device in order to stop game time.

2. The timing method according to claim 1, wherein the at least one optical ball detector comprises the at least one optical sensor, which is a colour camera or an infrared camera, the at least one optical sensor comprising a unit for acquiring the images taken by the camera in order to supply a data signal relating to the taken images, and wherein a processing unit is provided in the at least one optical ball detector and/or in the at least one visual ball detector, or in the timing device for processing the data signal, wherein the processing unit processes the data signal by way of timing software in order to determine the moment when the ball passes into the rim of the basketball hoop in order to stop the game time.

3. The timing method according to claim 1, wherein the at least one optical ball detector comprises at least one optical sensor and at least one light source intended to supply a ray of light in the direction of the at least one optical sensor, the at least one optical sensor and the at least one light source being positioned level with the rim of the basketball hoop with the light source facing the at least one optical sensor in a diametrically opposite position, wherein the at least one optical sensor detects the entry of the ball into the rim of the basketball hoop through the absence of reception of the light signal and supplies a detection signal for the timing device in order to stop the game time.

4. The timing method according to claim 3, wherein the at least one optical sensor furthermore detects the moment when the ball is level with or below the rim of the basketball hoop through reception of the light signal following the absence of reception of the light signal from the light source, so as to supply a detection signal to the timing device in order to stop the game time.

5. A timing system for timing a basketball match, comprising:

a timing device linked to at least one optical ball detector and/or linked to at least one visual ball detector for detecting a ball in a basketball hoop that includes a rim and a net, the at least one optical ball detector comprising at least one optical sensor, which is positioned near or on the basketball hoop, and the at least one visual ball detector comprising one or more kinetic cameras for detecting the motion and the position of the ball with respect to the basketball hoop, wherein the at least one optical ball detector and/or the at least one visual ball detector are intended to transmit at least one signal detecting the passage of the ball into the basketball hoop to the timing device so as to stop game time.

6. The timing system according to claim 5, wherein the at least one optical sensor is intended to capture the passage of the basketball ball into the rim of the basketball hoop from above the hoop in order to transmit the detection signal to the timing device in order to stop the game time.

7. The timing system according to claim 5, wherein the at least one optical sensor is a colour camera or an infrared camera, wherein the at least one optical sensor comprises a unit for acquiring the images taken by the camera, which unit is intended to supply a data signal relating to the taken images, and wherein a processing unit is provided in the at least one optical ball detector and/or in the at least one visual ball detector or in the timing device for processing the data signal, the processing unit being intended to process the data signal by way of timing software in order to determine the moment when the ball passes into the rim of the basketball hoop in order to stop the game time.

8. The timing system according to claim 5, wherein the at least one optical ball detector comprises at least one optical sensor and at least one light source intended to supply a ray of light in the direction of the at least one optical sensor, wherein the at least one optical sensor and the light source are configured to be positioned level with the rim of the basketball hoop with the light source facing the at least one optical sensor in a diametrically opposite position, wherein the at least one optical sensor is configured to detect the entry of the ball into the rim of the basketball hoop through the absence of reception of the light signal and to supply a detection signal for the timing device in order to stop the game time.

9. The timing system according to claim 7, wherein the at least one optical sensor is intended to be situated in a first position on the rim of the basketball hoop or on a connection fitting for connecting the basketball hoop to a basketball backboard or on the basketball backboard.

10. The timing system according to claim 8, wherein the at least one light source is intended to be situated in a second position on a surface of the rim identical to a surface of the rim where the at least one optical sensor is situated, wherein a first position where the at least one optical sensor is situated is in a direction of a connection fitting for the basketball hoop, whereas the second position where the at least one light source is situated at a position on the surface of the rim diametrically opposite the first position where the at least one optical sensor is situated.

11. The timing system according to claim 10, wherein the at least one optical ball detector comprises a plurality of optical sensors intended to be situated at various positions on a surface of the rim, and a plurality of light sources, wherein each optical sensor of the plurality of optical sensors is intended to be situated on the rim facing and diametrically opposite a respective light source, which is configured to supply a ray of light in the direction of the corresponding optical sensor.

12. The timing system according to claim 11, wherein the at least one optical ball detector is configured to transmit a detection signal from each optical sensor of the plurality of optical sensors to a processing unit in the at least one optical ball detector for transfer to the timing device, or in the timing device, in order to determine a stoppage in play.

13. The timing system according to claim 11, wherein each of the at least one light source is a light-emitting diode or an emission source of a laser beam.

14. The timing system according to claim 13, wherein the ray of light generated by each of the at least one light source is of a different colour.

15. The timing system according to claim 5, wherein the at least one optical sensor comprises at least one photoreceptive diode or an array of photoreceptive diodes.

16. The timing system according to claim 5, wherein the at least one visual ball detector, which comprises one or more kinetic cameras, is configured to transmit at least one detection signal from each camera to a processing unit in the at least one visual ball detector for transfer to the timing device, or in the timing device, in order to determine a stoppage in play.

* * * * *